United States Patent [19]

Pöhl

[11] Patent Number: 4,608,922

[45] Date of Patent: Sep. 2, 1986

[54] FRAMELESS HIGH PRESSURE PLATEN PRESS

[76] Inventor: Andreas Pöhl, Haydnstrasse 5, 8077 Reichertshofen, Fed. Rep. of Germany

[21] Appl. No.: 732,543

[22] Filed: May 10, 1985

[30] Foreign Application Priority Data

May 12, 1984 [DE] Fed. Rep. of Germany ..... 3417712

[51] Int. Cl.[4] ..... B30B 15/00

[52] U.S. Cl. ..... 100/264; 100/269 A; 100/269 R; 100/278; 156/580

[58] Field of Search ..... 100/214, 212, 264, 278, 100/279, 280, 269 A, 269 R, 296; 156/580, 581; 72/429; 83/53, 623

[56] References Cited

U.S. PATENT DOCUMENTS

| | | | |
|---|---|---|---|
| 211,599 | 1/1879 | Smithson | 100/279 X |
| 829,125 | 8/1906 | Romunder | 156/581 X |
| 2,448,288 | 8/1948 | Alk | 100/278 |

OTHER PUBLICATIONS

"Vielseitiges Reproduzierverfahren", *HOB*, 10/84–34.

*Primary Examiner*—Billy J. Wilhite

*Attorney, Agent, or Firm*—Wegner & Bretschneider

[57] ABSTRACT

A high pressure press is made without the need for a press frame by wrapping the press plates with a belt. A raising device is located between the plates and the belt, and closes the plates by transmission of force to the belt, which in turn acts upon the plates.

10 Claims, 8 Drawing Figures

FRAMELESS HIGH PRESSURE PLATEN PRESS

BACKGROUND OF THE INVENTION

1. Field of the Invention

The present invention relates to a press, and more particularly to a high pressure platen press utilized in the formation of decorative laminates, high density board, chipboard and the like.

2. Description of the Prior Art

High pressure platen presses are well known and in general use in the industry. Nearly without exception these presses are built from three components: upper and lower press plates of which at least one is to be raised or lowered; a hydraulic or mechanical device to raise the above-mentioned press plate; and a frame which counteracts all the bending moments created by the above-mentioned hydraulic device.

Through the linear growth of the specific pressure in the press, the bending moment of the components also potentially grows. Because of this relationship, the quantity of steel used to build such a press increases, along with the price.

SUMMARY OF THE INVENTION

An object of the present invention is to provide a high pressure platen-press where these mechanical rules are not valid and to reduce weight and price. It is a further object to create advantageous movements during closing of the press, which makes it possible to produce higher quality products.

The above objects are attained according to the instant invention in a new type of press where the main component, the press frame, is missing. Until now, in a conventional press the raising device was resting on the press frame and the same press frame had to withstand without deformation all forces and bending moments. By the present invention all forces and moments are directed to one or both of the press plates. These effects are accomplished in accordance with the present invention through the construction where the two press plates are wrapped around with a steel belt or rope. The raising device preferably is placed in the geometric middle of the press plates (which preferably are symmetrical), under the wrapping belt. By opening the raising device, the belt is tightened or the belt configuration is changed, and the two press plates are closed.

DETAILED DESCRIPTION

Figure 4:
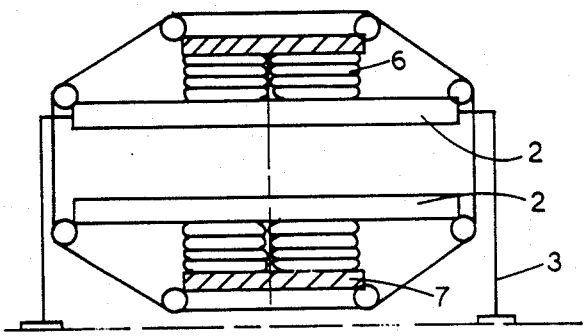
FIG. 4 is a sectional side view of a second embodiment of the present invention.
Figure 5A:
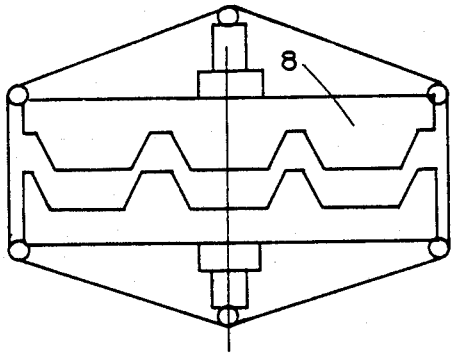
FIGS. 5*a* and 5*b* show two presses according to the present invention, utilizing die faces instead of press plates.
Figure 5B:
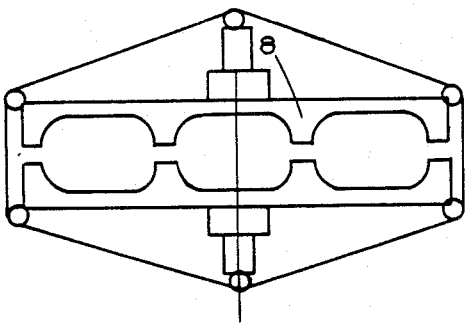
Figure 7:
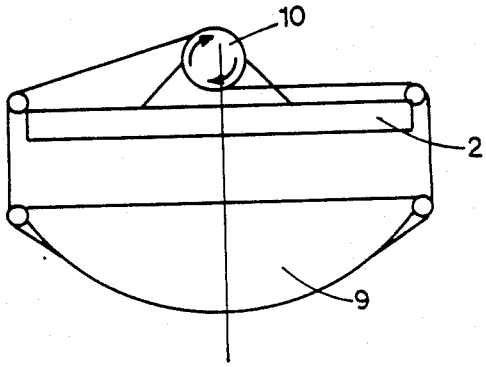
FIG. 7 shows the press of FIG. 6, with mechanical tightening of the belt with a winch.

Referring to the drawings, 1 represents an object to be pressed, located between upper and lower press plates 2. Support 3 is provided for the plates, which can be a floor stand as shown in FIG. 4. Roller bearings are provided at the edges of the plates, around which belt 4 is wrapped. The belt is preferably of steel, and may be in the form of a rope or sheet. As shown in FIG. 5, the press plates may take the form of dies or tools 8. A raising device 5 is located between at least one of the press plates and the belt. As shown in FIG. 4 the raising device may be a multiply-inflatable pneumatic lift 6, supporting a platform 7 which carries bearings. As shown in FIG. 7, the raising device may be a winch 10 to which the ends of the device are connected, providing mechanical tightening of the belt. The raising device may be any known electrical, mechanical, hydraulic, pneumatic or manual device providing the function shown in FIGS. 1 and 2.

Figure 1:
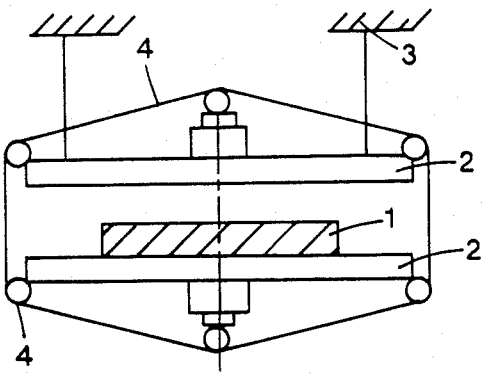
FIG. 1 shows a sectional side view of a press according to the present invention, in the open state.
Figure 2:
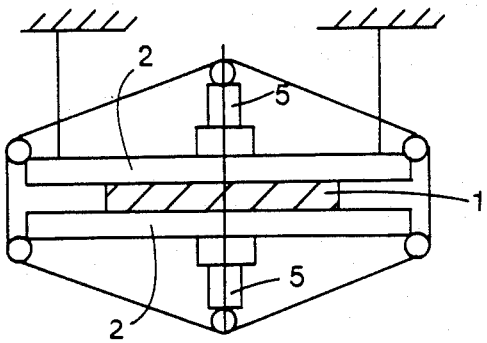
FIG. 2 shows the press of FIG. 1 in the closed state.

As shown in FIG. 1, the high pressure platen press according to the instant invention has roller bearings on the outer edge of the press plates and on the top of each raising device. Around these bearings, and thus around the actual press plates, a belt (preferably of steel) is wrapped.

Figure 6:
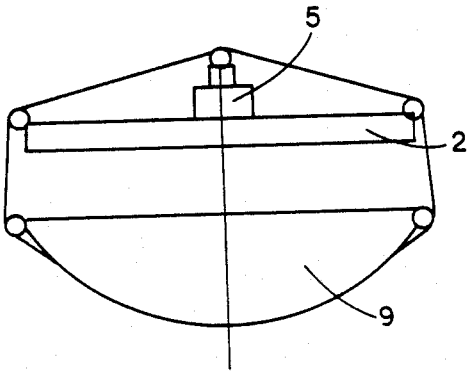
FIG. 6 shows a press according to the present invention utilizing a single raising device.

The raising devices can be positioned in a "double sided" manner if the press plates are relatively thin and the so-called centerflow effect is desired (FIG. 1), or only on one side if at least one of the press plates is rigid, as shown at 9 in FIG. 6.

Figure 3:
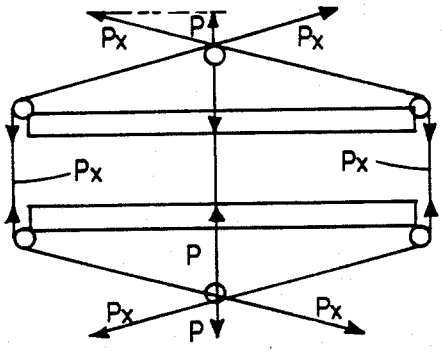
FIG. 3 is a schematic representation of the press of the present invention, showing force directions.

Upon expanding the raising device, the produced power P (FIG. 3) is divided into two components Px which represent on each side a quintupled force (by the 15° belt angle) over the original power P. The 15° belt angle refers to the angle formed by the belt with respect to a plane or line connecting the points where the roller bearings are attached to the press plates. This relationship can be seen in the drawings. Directed over the bearings, the two Px components thus are closing the press with a tenfold power. Added to this closing power is the original force, i.e., the force of the raising device. In a favorable position, if force P is produced, then 11 P is transferred and sustained on the press plates.

To provide this action of the P force, the forces of the raising devices, which rests on the point or line where the raising device is fitted, should be based at the geometric center, i.e., along the respective centerlines, of the press plates. This results in the power moving outwards from the middle or the centerflow effect. The roller bearings fitted to the edges of the press plates shown in every FIG. serve not only to change the direction of the closing power but also make possible the self-adjustment of the press plates.

The force which closes the press plates is based directly on the press plate itself. Thus, a press frame is unnecessary. The force created by the raising device divides into two components. Each one is up to five times larger than the original force. However, these forces are acting in the wrong direction, but are directed with roller bearings without loss to the ten fold closing power increase. As the raising device increases closing power, the pressure increases along the central axis. Thus, if the press plate is flexible enough, the press is closing at first along the central axis. Later, by further increasing the closing power, the pressure is transferred from the middle in the direction of the outer skirts of the press plates. In accordance with the objects of the present invention this is one of the important characteristics of this high pressure press and makes possible the processing of difficult water- and airinhibited materials. This action is the centerflow mentioned above. As a physical low, by opening the raising device, the belts are tightening at first where the lowest counteraction is. Utilizing this behavior results in the self-adjustment of the press plates.

What is claimed is:

1. A high pressure press, comprising: first and second opposed plates; wrapping means surrounding said plates; raising means between at least one of said plates and said wrapping means located on the geometric centerline of the plate, for exerting force on said wrapping means and forcing said plates toward each other.

2. The press of claim 1, further comprising roller means at the edges of said plates and on said raising means, over which said wrapping means passes.

3. The press of claim 1, wherein each of said first and second plates is provided with raising means.

4. The press of claim 1, wherein said wrapping means is made of steel.

5. The press of claim 4, wherein said wrapping means is selected from the group consisting of a belt, a rope or a sheet.

6. The press of claim 1, wherein the raising means is selected from the group consisting of hydraulically, pneumatically, electrically and manually operable devices.

7. The press of claim 1, wherein the first and second plates are in the form of dies.

8. The press of claim 1, wherein the first and second plates are in the form of tools.

9. The press of claim 1, wherein the wrapping means has first and second ends and said raising means is a winch to which said first and second ends are attached.

10. A high pressure press, comprising:

first and second opposed plates;

wrapping means surrounding said plates;

raising means between at least one of said plates and said wrapping means for exerting force on said wrapping means and forcing said plates toward each other; and roller means at the edges of said plates and on said raising means, over which said wrapping means passes.

* * * * *